United States Patent [19]

Schiller et al.

[11] 4,438,416

[45] Mar. 20, 1984

[54] PICOSECOND DELAY DEVICE

[75] Inventors: Norman H. Schiller, Queens; Robert R. Alfano, Bronx, both of N.Y.

[73] Assignee: Hamamatsu Corporation, Middlesex, N.J.

[21] Appl. No.: 342,486

[22] Filed: Jan. 25, 1982

[51] Int. Cl.[3] ..... H01P 9/00

[52] U.S. Cl. ..... 333/160; 333/245

[58] Field of Search ..... 333/138–140, 333/156, 160, 161, 164, 245

[56] References Cited

U.S. PATENT DOCUMENTS

| | | | |
|---|---|---|---|
| 3,013,227 | 12/1961 | Jordan | 333/161 |
| 3,238,300 | 3/1966 | Bopp et al. | 333/139 X |
| 3,568,097 | 3/1971 | Hyltin | 333/161 |
| 3,781,722 | 12/1973 | Pierson | 333/156 |
| 4,356,462 | 10/1982 | Bowman | 333/161 X |

*Primary Examiner*—Marvin L. Nussbaum

*Attorney, Agent, or Firm*—Irving M. Kriegsman

[57] ABSTRACT

An electrical device for use in delaying the time of arrival of an electrical signal with fixed increments of delay in the picosecond range and having a minimum delay time in picoseconds is disclosed. In one embodiment of the invention, the device comprises a plurality of small T shaped RF coaxial connectors fixedly coupled together in series with the connectors themselves serving as delay elements. One of the unconnected (open) ports of the connector at one end of the series is used as the entrance port for the device and the other unconnected ports of the connectors in the series are used as exit ports for the device. An electrical signal introduced into the device through the entrance port and then exiting through one of the exit ports is delayed according to the total path length travelled by the signal in passing from the entrance port to the particular exit port selected to be used as the exit port, each port in the path travelled by the signal from the entrance port to the exit port producing a time delay in the order of picoseconds, the exact number of picoseconds for a port depending on the specific type of connector employed. In another embodiment of the invention, a plurality of transmission lines having different lengths between about 10 to 100 mm etched on a printed circuit board are connected to individual double pole double throw switches which are coupled together in series, each transmission line causing a time delay of a signal passing through it of a different number of picoseconds.

8 Claims, 2 Drawing Figures

PICOSECOND DELAY DEVICE

BACKGROUND OF THE INVENTION

The present invention relates generally to electrical delay devices, and more particularly to an electrical delay device which is capable of delaying an electrical signal by any one of a number of fixed step increments in the picosecond range.

Electrical delay devices which are capable of delaying the time of arrival of an electrical signal over any one of a number of fixed increments are well-known in the art and are commonly used in and with a variety of electrical and electrooptical systems for test and other purposes. For example, electrical delay devices are often used in adjusting the delay time of a trigger signal in a streak camera system. A discussion of streak camera systems may be found in an article entitled "An Ultrafast Steak Camera System: Temporaldisperser and Analyzer" appearing in the June, 1980, issue of *Optical Spectra,* which article is incorporated herein by reference.

DESCRIPTION OF PRIOR ART

One known type of electrical delay device which is used in adjusting the delay time of the trigger signal in a streak camera system comprises a plurality of different sized lengths of coaxial cable. The lengths of coaxial cable are mounted in a box which is provided with a single input port and a single output port. Each length of cable is coupled to a different lever. By depressing one or more levers, different combinations of cable lengths are introduced between the input port and the output port. The device furnishes time delays at increments of 0.25 nanoseconds starting at a delay time of 2.5 nanoseconds and is based on the realization that an electrical signal travels in a coaxial cable at a speed of around 1.5 nanoseconds per foot.

One of the shortcomings with this type of delay unit is that because of the physical size of coaxial cable and the delays produced in the connecting parts utilized in coupling the different lengths of cable to the input port and the output port as sell as the delays produced by the input and output prots themselves the minimum delay that is achieved is around 2.5 nanoseconds and the incremental delays that are achieved are around 0.25 nanoseconds. For many applications, a minimum delay time and delay increments of much lower values, i.e. in the picosecond range, are either desired or required.

It is the general purpose of this invention to produce a delay device which is capable of producing smaller time delays than have hitherto been obtainable.

SUMMARY OF THE INVENTION

It is an object of this invention to provide a new and improved electrical delay device for use in delaying the time of arrival of an electrical signal.

It is another object of this invention to provide a delay device which is capable of delaying the time of arrival of an electrical signal at any one of a number of fixed increments in the picosecond range and with a minimum delay time in the picosecond range.

It is still another object of this invention to provide a delay device as described above which may be constructed from commercially available components, which is easy and economical to manufacture and which is easy to use.

It is yet still another object of this invention to provide a delay device of the type described above which does not involve the use of different lengths of cable to provide time delays of different durations.

A delay device constructed according to one embodiment of the present invention comprises a plurality of small three-port RF coaxial connectors fixedly coupled together in a series relationship, the time delay produced by a signal passed through each port being on the order of around 15 to 60 picoseconds depending on the particular type and kind of connector used. A signal introduced into any one port and coupled out of any other port is delayed in time in accordance with the total number of ports through which the signal is passed and the delay produced in each port.

For example, if the connectors are all of the same type and if each port in each connector produces a time delay of about 30 picoseconds, a signal entering one of the unconnected ports of the connector at one end of the series and leaving by the other unconnected port of the same connector will pass through two ports and thus be delayed two times 30 or about 60 picoseconds. On the other hand, if the signal is coupled out of the unconnected port in the next following connector in the series it will have passed through a total of four ports in the device and be delayed four times 30 or about 120 picoseconds.

In another embodiment of the invention a plurality of transmission lines of different lengths etched on a printed circuit board are connected to individual double pole double throw switches which are connected in series, the lengths of the transmission lines being in the range of about 3 to 100 mm. Each transmission line produces a time delay of a signal passing through it a different number of picoseconds depending on its particular length. The switch at one end of the series is connected to a connector which serves as the entrance port for the deivce and the switch at the other end of the series is connected to a connector which serves as the exit port for the deivce. When the switch associated with a particular transmission line is in an open positon the transmission line associated with it is out of the series circuit and when the switch is in the closed position the transmission line associated with it is in the series circuit. Thus, the total delay produced is dependent on the switch positions of the individual switches.

The foregoing and other objects and advantages will appear from the description to follow. In the description, reference is made to the accompanying drawings which form a part thereof, and in which is shown by way of illustrating, specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF PREFERRED EMBODIMENT

The present invention is directed to a delay device which is capable of delaying the time of arrival of an electrical signal over a number of fixed increments in the picosecond range and starting with a minimum time delay in the picosecond range.

The present invention accomplishes this in one embodiment by providing a delay device in the form of a plurality of small three-port RF coaxial connectors which are coupled together in series relationship, with the ports in the connectors serving as delay elements. By using one of the two unconnected ports in the connector at one end in the series as the entrance port of the device and the other unconnected ports in the series as exit ports for the device, different time delays are obtained by introducing the signal into the entrance port and then coupling the signal out of different exit ports, the delay so obtained in each instance depending on the particular port selected for use as the output port. The invention is based partly on the realization that the delay time produced in a signal when it is passed through a port in a small conventional commercially available RF coaxial connector is typically around 15 to 60 picoseconds, depending on the particular connector employed. Thus, a signal traveling through two ports each producing a delay of about 15 picoseconds will be delayed about 30 picoseconds and a signal traveling through four ports each producing a delay of about 15 picoseconds will be delayed about 60 picoseconds.

Figure 1:
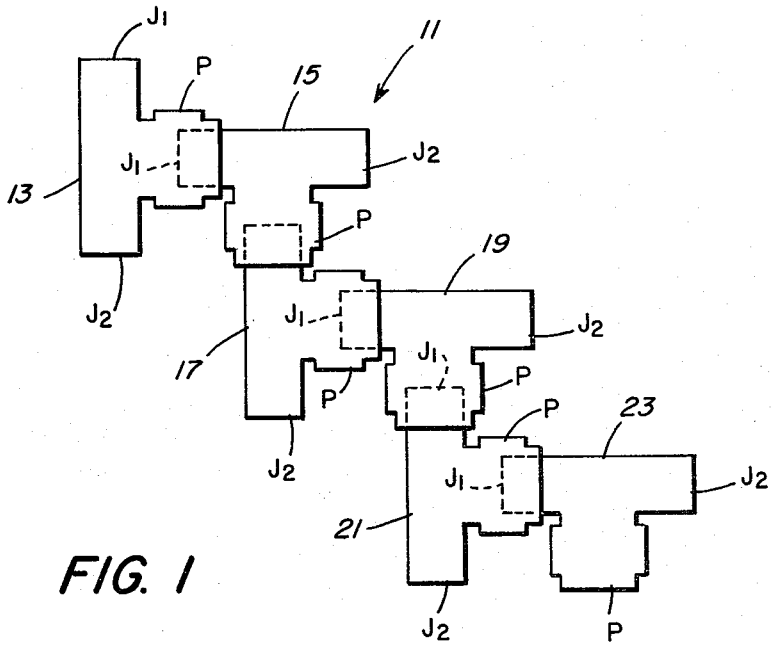
FIG. 1 is a diagrammatic representation of one embodiment of a delay device constructed according to the teachings of the present invention.

Referring now to FIG. 1, there is illustrated an embodiment of a delay device constructed according to the teachings of this invention and identified generally by reference numeral 11. Delay device 11 includes six Bunker Ramo Amphenol Number 31-008 (Military number UG-274) T type BNC RF coaxial connectors numbered in order starting from the left by reference numerals 13, 15, 17, 19, 21 and 23 respectively. Each connector includes two end jack type ports identified $J_1$ and $J_2$ and one center plug type port P. The connectors are coupled together in a "cascaded" series relationship and permanently secured to each other in the series such as by welding or soldering (not shown). Thus, port P of connector 13 is coupled to port $J_1$ of connector 15, port P of connector 15 is coupled to port $J_1$ of connector 17, port P of connector 17 is coupled to port $J_1$ of connector 19, port P of connector 19 is coupled to port $J_1$ in connector 21 and port P of connector 23 is coupled to port $J_1$ of connector 23.

Port $J_1$ of connector 13 serves as the input port for device 11 while ports $J_2$ of connectors 13, 15, 27, 19, 21 and 23 and port P of connector 21 each serve as output ports for device 11. Port $J_2$ of connector 23 provides a delay about equal to that of port P connector 23 since both of these ports are the same electrical distance from port $J_1$ of connector 13. Since the size of the ports in this particular type connector are such as to produce time delays on the order of about 25 picoseconds of a signal passing through it, a signal entering the input port (i.e. port $J_1$) in connector 13, and exiting through port $J_2$ in connector 13 is delayed about 50 picoseconds. Similarly, a signal entering the input port and exiting through exit ports $J_2$ in connectors 15, 17, 19, 21 and 23 will be delayed about 100, 150, 200, 250 and 300 picoseconds, respectively. If the signals exit from port F of connector 23 the delay will be about 250 picoseconds. Thus, device 11 delays an electrical signal from about 50 to 250 picoseconds at increments of about 50 picoseconds.

By using other type connectors such as connectors sized that the ports produce delays of 15 picoseconds, time delays of 30, 60, 90, 120, 150 and 180 picoseconds can be produced. Similarly, if the time delays per port are about 50 picoseconds, time delays of about 100, 200, 300, 400, 500 and 600 picoseconds can be provided.

The group of connectors may be mounted in a suitable housing (not shown) and need not all lie in a common plane.

As can be appreciated, the invention may be practiced using T connectors other than BNC type connectors, such as N, HN, SMA, TNC, etc. to produce other sized incremental and total delays. Also, the particular number of connectors may be greater or less than six to produce more or less than six incremental time delays, if so desired. In addition, the connectors need not all be of the same type or the same kind. For example, a plurality of T shaped connectors could be connected in end-to-end series relationship by alternating matching jack-plug-jack and plug-jack-plug type connectors. Furthermore, straight type of L type connectors may be coupled into the series between the T connectors at one or more locations to further modify the delay times at certain output ports.

Figure 2:
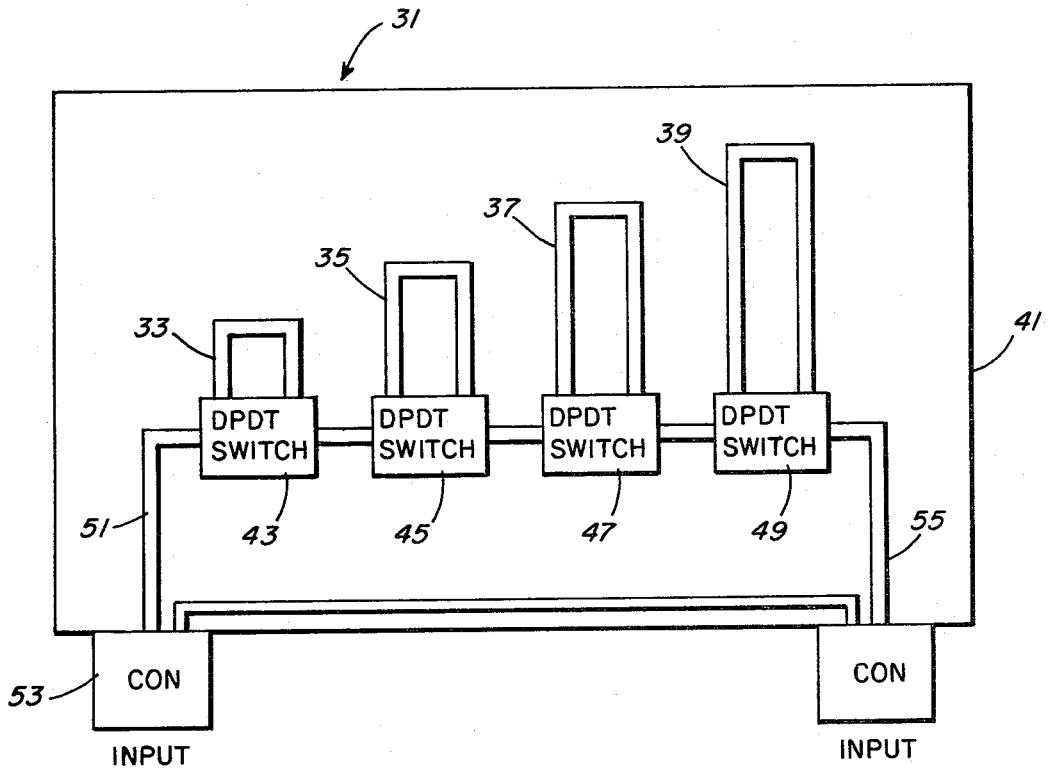
FIG. 2 is a schematic circuit diagram of another embodiment of a delay device constructed according to the teachings of the present invention.

Referring now to FIG. 2 there is illustrated another embodiment of a delay device constructed according to the teachings of the present invention and identified by reference numeral 31.

Delay device 31 includes a plurality 50 ohm transmission lines 33, 35, 37 and 39 of etched copper on a printed circuit board 41 having a ground plane. Each transmission line is coupled to a separate double pole double throw switch, transmission line 33 being coupled to switch 43, transmission line 35 being coupled to switch 45, transmission line 37 being coupled to switch 47 and transmission line 39 being coupled to switch 49. Transmission line 33 has a length of about 9.7 mm which produces a time delay of about 25 picoseconds, transmission line 35 has a length of about 19.5 mm producing a time delay of about 50 picoseconds, transmission line 37 has a length of about 38.7 mm producing a time delay of about 100 picoseconds and transmission line 39 has a length of about 77.4 mm producing a time delay of about 200 picoseconds. Switch 43 is connected through a length of 50 ohm transmission line 51 of etched copper to an RF coaxial BNC connector 53 Amphenol number 31-218 which serves as the entrance port of the device and switch 49 is connected through a 50 ohm transmission line 55 of etched copier to an RF coaxial BNC connector 57 Amphenol number 31-218 which serves as the exit port for the device. Connectors 53 and 57 and tranmission lines 51 and 57 collectively produce a time delay of about 600 picoseconds. Therefore if all four switches are open, the time delay of the device 31 is about 600 picoseconds. If switch 43 is closed and the other three switches are open the time delay is 625 picoseconds. If switches 43 and 45 are closed the time delay is 675 picoseconds. If all four switches are closed the time delay is 975 picoseconds. As can be appreciated by closing different combinations of switches, different time delays between 600 and 975 picoseconds can be realized.

As can be appreciated, the total number of transmission lines (and associated switches) and the particular lengths of the transmission lines may be changed as desired.

The foregoing description is considered as illustrative only of the principles of the invention. Further, since numerous modifications and changes will readily occur to those skilled in the art it is not desired to limit the invention to the exact construction and operation shown and described, and accordingly all suitable modifications and equivalents may be resorted to, falling within the scope of the invention as claimed.

What is claimed is:

1. A delay device for use in delaying the time of arrival of an electrical signal at fixed increments in the picosecond range and starting at a time interval in the picosecond range, said delay device comprising a plurality of three port electrical connectors fixedly coupled together in series relationship, the construction and physical length of each port of each connector being such as to produce a time delay in the picosecond range of an electrical signal passing through, whereby an electrical signal introduced into any one port and emerging through any other port will be delayed in time in accordance with the total number of ports through which the signal is passed.

2. The delay device of claim 1 and wherein said connectors are equal in size and type so as to produce fixed step increments of equal size.

3. The delay device of claim 1 and wherein said connectors are T shaped connectors.

4. The delay device of claim 3 and wherein said T connectors are RF coaxial BNC type connectors, the effective electrical path length of each port being around 12/32 of an inch.

5. The delay device of claim 4 and wherein said connector at one end of the series has an open port serving as an entrance port and at least some of the other open ports of the series serve as exit ports.

6. The delay device of claim 5 and wherein said step increments are on the order of around 30 picoseconds.

7. The delay device of claim 1 and wherein said T connectors are all jack-plug-jack type connectors coupled together in a cascaded series relationship.

8. The delay device of claim 7 and wherein said plurality of T connectors consists of five T connectors providing time delays of around 30, 60, 90, 120, 150 and 180 picoseconds.

* * * * *